US005169447A

United States Patent [19]

Jonovic et al.

[11] Patent Number: 5,169,447

[45] Date of Patent: Dec. 8, 1992

[54] ADHESIVE APPLICATOR

[75] Inventors: John A. Jonovic, Fitchburg; Richard H. Reese, Madison, both of Wis.

[73] Assignee: Oscar Mayer Foods Corporation, Madison, Wis.

[21] Appl. No.: 638,480

[22] Filed: Jan. 4, 1991

[51] Int. Cl.[5] ..... B05C 1/02

[52] U.S. Cl. ..... 118/211; 118/220; 118/243; 118/241

[58] Field of Search ..... 118/211, 220, 243, 241, 118/500; 156/69, 578

[56] References Cited

U.S. PATENT DOCUMENTS

| | | | |
|---|---|---|---|
| 3,034,478 | 5/1962 | Schwartz | 118/243 |
| 3,349,540 | 10/1967 | Jensen et al. . | |
| 3,478,488 | 11/1969 | Jensen et al. . | |
| 3,498,018 | 3/1970 | Seiferth et al. . | |
| 3,933,187 | 1/1976 | Marlinski | 156/578 |
| 4,102,304 | 7/1978 | Debenham | 118/410 |
| 4,112,531 | 9/1978 | Mitter | 118/211 |
| 4,456,446 | 6/1984 | König | 118/243 |

*Primary Examiner*—W. Gary Jones

*Assistant Examiner*—Brenda Lamb

*Attorney, Agent, or Firm*—Lockwood, Alex, FitzGibbon & Cummings

[57] ABSTRACT

Apparatus for applying adhesive to a seal area of an article, particularly a package component, or simultaneously to a seal area of each of a plurality of package components. The apparatus may consist of a single unit or a gang of units. Each unit incorporates a receptacle for holding a body of adhesive which may be heated and which may be connected to a source of supply. An adhesive pick-up and applicator element has a lip which has a surface for picking up adhesive when it is raised out of a body of adhesive in which it has been immersed. The adhesive pick-up and applicator element can be in the form of a sleeve or cylinder with the rim serving as the adhesive pick-up lip. An actuator is connected with each adhesive pick-up and applicator element so as to reciprocate it between a lowered position in which the lip is immersed in adhesive and a raised position in which the lip engages and applies or deposits adhesive on the seal area of a package component or other article.

8 Claims, 7 Drawing Sheets

ADHESIVE APPLICATOR

BACKGROUND AND DESCRIPTION OF THE INVENTION

This invention relates to an apparatus or machine for applying adhesive to a predetermined area on a surface of an article. More particularly, the invention relates to an apparatus or machine for use in the production of packages in large quantities in which there is a requirement for applying or depositing adhesive on a predetermined area of a succession of package-forming components with the deposited adhesive being subsequently relied on to form an hermetic seal.

In recent years one type of package that has achieved a high degree of commercial success has comprised a relatively stiff or semi-rigid backing member or base component on which a product to be packaged is located and over which is secured a transparent cover which may be in the form of either a preformed transparent plastic bubble or a transparent film. This type of package has been widely used in the food industry for packaging sliced luncheon meats and cheese. One such package and method and apparatus for forming the same is disclosed in U.S. Pat. No. 3,498,018 to Oscar F. Seiferth et al.; U.S. Pat. No. 3,349,540 dated Oct. 31, 1967 to Hans A. Jensen et al.; and U.S. Pat. No. 3,478,488 dated Nov. 18, 1969 to Hans A. Jensen et al. Similar packages are also widely used for display-packaging of a wide variety of non-food articles in so-called "blister" packages.

In forming packages of the foregoing type, various systems have been used for applying or depositing adhesive to the seal areas of the stiff or semi-rigid backing components, although the adhesive has also or alternatively been applied to the transparent bubble or blister component. One such system and apparatus is disclosed in the above-mentioned U.S. Pat. No. 3,349,540 wherein transfer rollers remove adhesive from a supply fountain and transfer the adhesive onto applicator rollers which in turn deposit the adhesive on the desired seal area on a semi-rigid plastic support or base used in forming a sliced food package.

The previous commercially used apparatus and methods of applying adhesive to the seal areas of package components have had several recognized draw-backs. In particular, the adhesives had to be applied in relatively viscous and heated condition which severely limited the types and properties of adhesives that could be used and tended to excessive consumption of adhesive.

In the apparatus and method of the present invention an adhesive pick-up and applicator element in the form of a sleeve has a lip at the top with a shape and area corresponding to the seal area on which it is desired to apply or deposit adhesive to a series of package components. Such an adhesive pick-up and applicator element is reciprocated between a lowered position in which the lip is immersed in a pool or bath of adhesive and an upper position in which the lip is raised above the surface of the adhesive and engages the seal area of an article to which the adhesive is to be applied or deposited. Depending upon production volume requirements, the apparatus of the present invention may consist of and be operated as a single unit or comprise a gang of units operating in unison.

The object of the invention, generally stated, is the provision of an improved apparatus and method for applying adhesive to package components and other articles in which the lip of an adhesive pick-up and applicator element is reciprocated so as alternately to be immersed below the surface of a body of adhesive and then raised above the surface into engagement with the seal area of the package component or other article having a seal area requiring the application of adhesive.

A number of other important and more specific objects of the invention will be apparent to those skilled in the prior art in view of the following Detailed Description of Preferred Embodiments of the Invention taken in conjunction with the accompanying drawings, wherein:

DETAILED DESCRIPTION OF PREFERRED EMBODIMENTS

Figure 1:
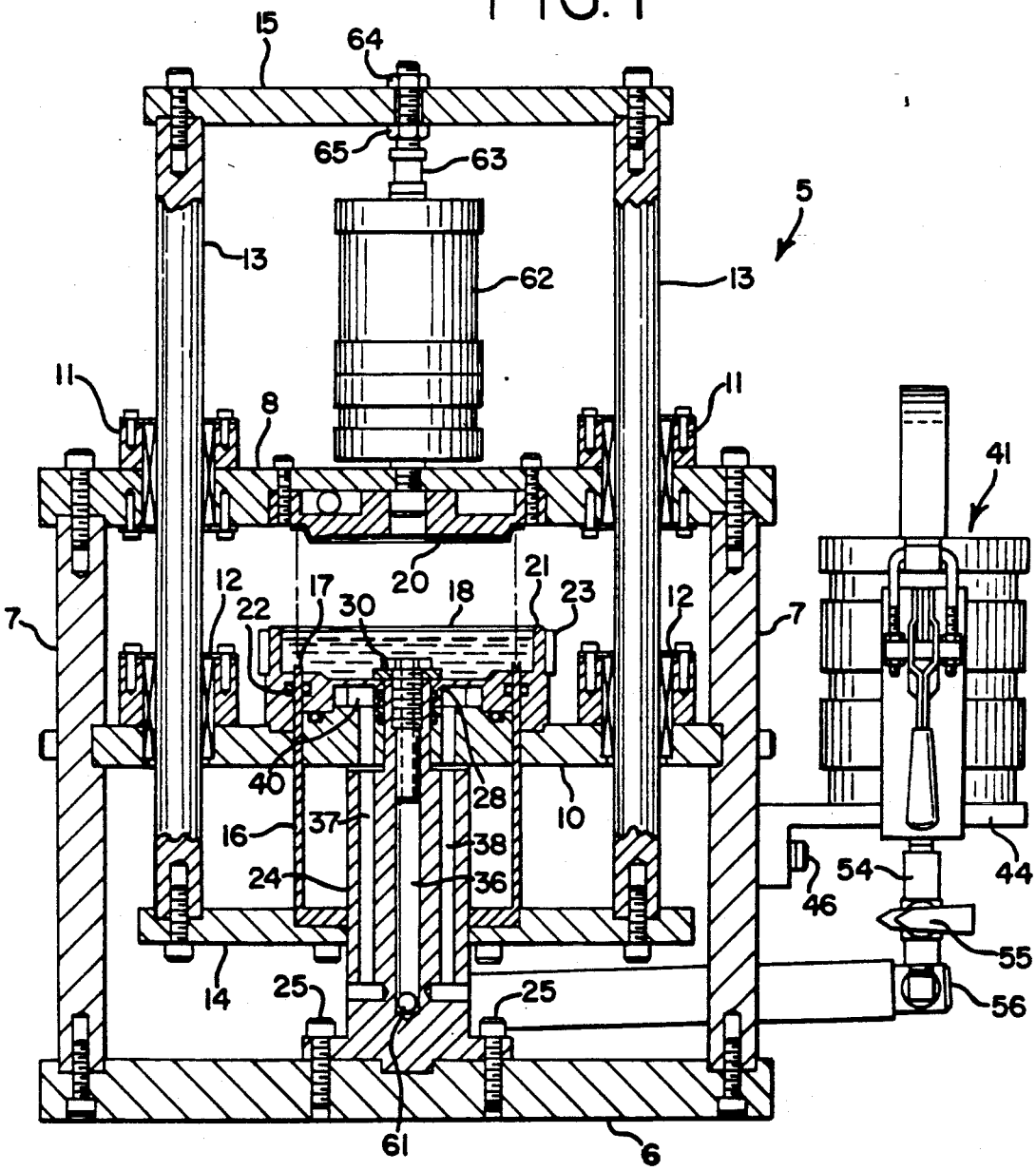
FIG. 1 is a view partly in side elevation and partly in section of a single unit adhesive applying apparatus embodying the invention with its reciprocating adhesive pick-up and applicator element shown in its immersed and lower position.
Figure 2:
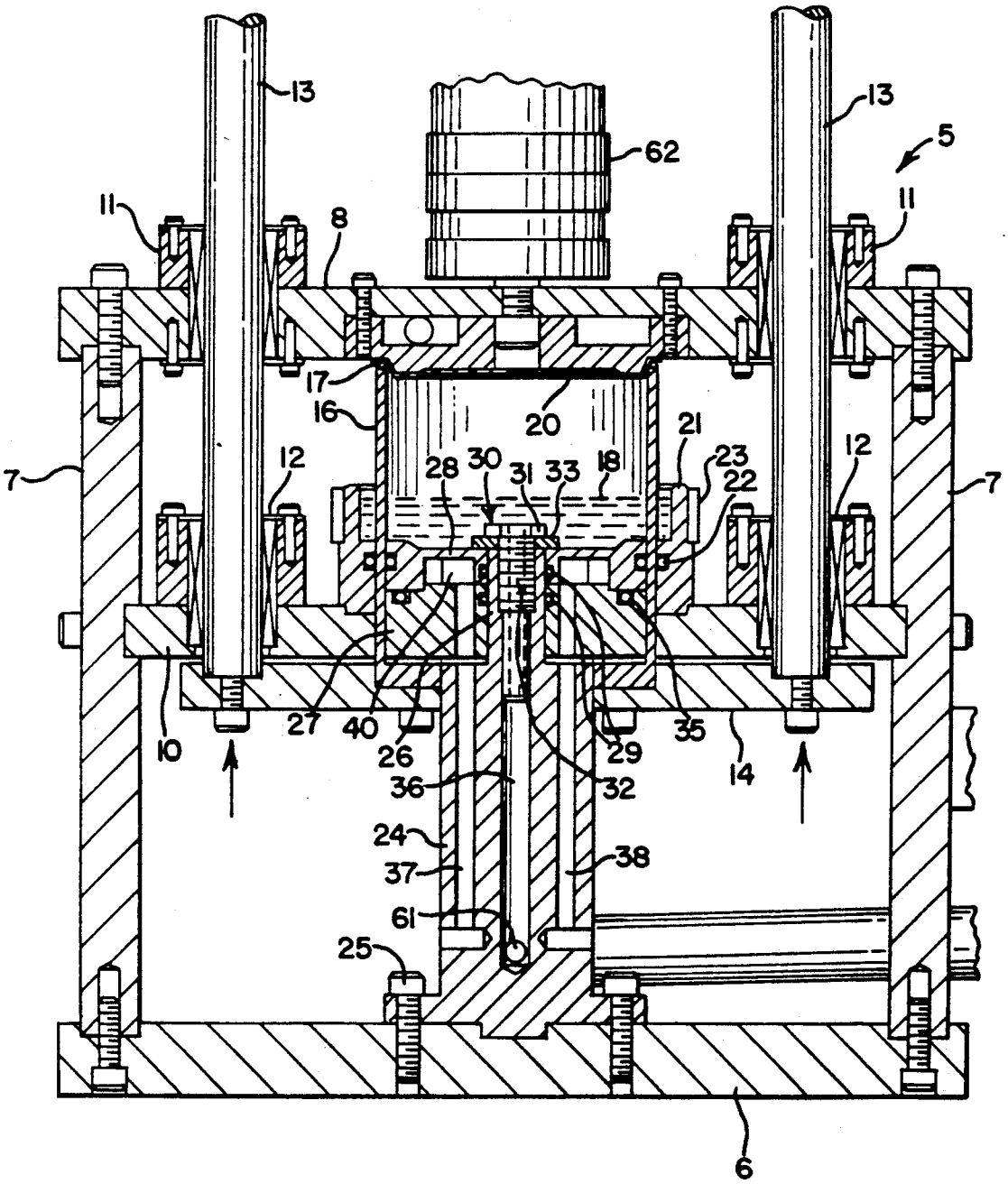
FIG. 2 is a view similar to FIG. 1 on larger scale and omitting a portion of the apparatus, and showing the reciprocating adhesive pick-up and applicator element in its elevated position engaging the seal area of a package component.

Referring to FIGS. 1-4, an adhesive applying apparatus is indicated generally at 5 therein which includes a frame comprising a base 6, side plates 7—7, a top plate 8 and an intermediate plate 10. The top plate 8 is provided with a set of four bushings 11—11 and the intermediate plate with a set of four bushings 12—12 in which a set of four posts 13—13 are vertically reciprocal. At their bottom ends, the posts 13 are supported on a cross plate 14 and at the top by a cross plate 15. An adhesive pick-up and applicator element 16 in the form of a cylinder closed at the bottom and open at the top is supported in a recess provided therefore on the upper side of the plate 14. The upper lip or rim 17 of the adhesive pick-up and applicator element 16 as shown in FIG. 1 occupies a lowered position in which it is immersed in a body of liquid adhesive indicated at 18. In FIG. 2, the lip 17 is shown in its elevated position above the body of adhesive 18 and in engagement with the seal area of a semi-rigid plastic base 20 of a sliced meat package (e.g. package 65 in FIGS. 11 and 12).

The body or pool 18 of adhesive is retained in a receptacle 21 mounted on the upper side of the intermediate plate 10. The cylindrical sleeve portion of element 16 is vertically reciprocal through the bottom of the receptacle 21 through an accommodating cylindrical slot therein in which a circumferential or O-ring seal 22 is located. The upper portion of the receptacle 21 is surrounded by circumferential electrical resistance heater of known type 23 which may be thermostatically regulated so as to maintain the temperature of the adhesive bath 18 within a predetermined temperature range.

Mounted on the center portion of the base plate 6 is a pedestal 24. A pair of bolts 25—25 secure the base of the pedestal 24 to the bottom plate 6. The main body of the pedestal 24 extends upwardly to the underside of the intermediate plate 10 and has an integral upper post 26 (FIG. 2) on the top which extends upwardly through an insert 27 and through a center opening in the bottom wall 28 of the receptacle 21. An adaptor 30 has a head 31 in the form of a hex nut and an exterially threaded hollow stem 32 which is threaded into the upper end of the post 26. A washer 33 is located underneath the head 31. It will be seen that by tightening down on the adaptor 30, washer 33 is compressed and the bottom wall 28 of the receptacle 21 is drawn down against the top side of the insert 27. O-ring seals 29 surround the post 26 where it passes through the insert 27 and the receptacle bottom 28. In addition, an 0 ring seal 35 is located in a groove in the top side of the insert 27 so as to form a liquid-tight seal between the receptacle bottom 28 and the upper surface of the insert 27.

The pedestal 24 including the post 26 has a vertical center passageway 36 for admitting adhesive upwardly therethrough and through the adaptor 30 and into the body of adhesive 18 so as to establish maintain the supply thereof. The pedestal 24 also has a pair of vertical passageways 37 and 38 communicating at the top with an annular space 40 (FIG. 2) in the underside of the bottom 28 of the receptacle 21. A heating medium may be admitted through one of the passageways 37 or 38 and withdrawn through the other so as to circulate and maintain the adhesive in the center passageway 36 at a desired temperature and also warm the bottom 28 of the receptacle 28 and assist in maintaining the predetermined temperature of the bath 18.

Figure 3:
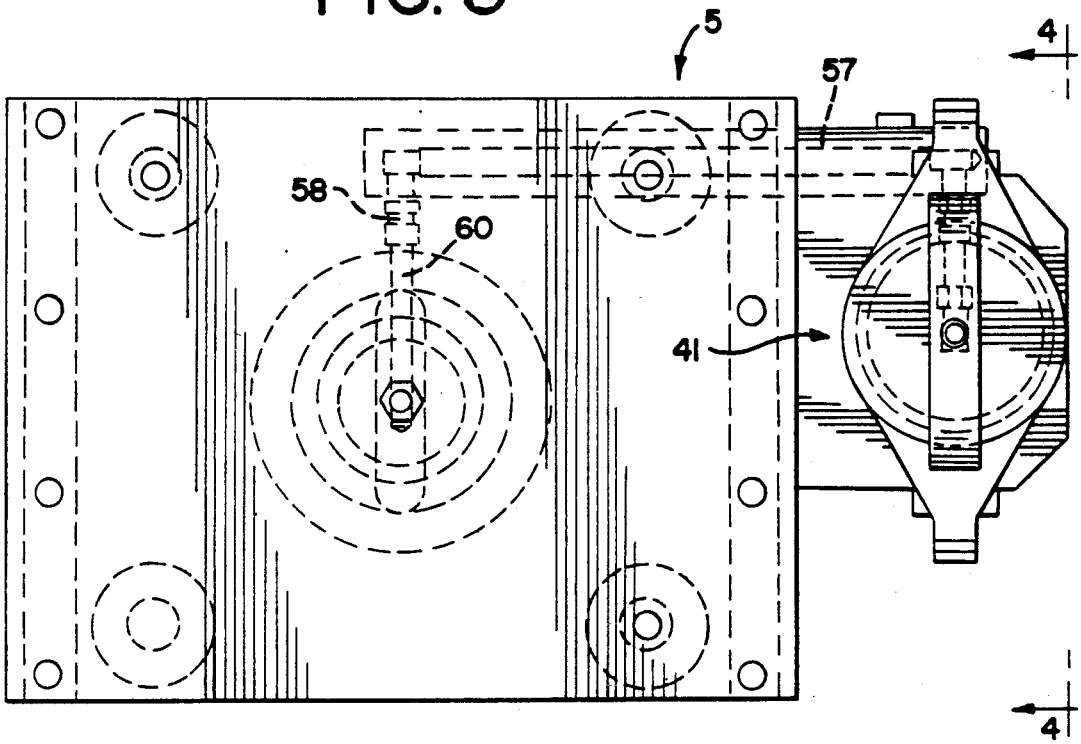
FIG. 3 is a top plan view of the apparatus shown in FIG. 1.
Figure 4:
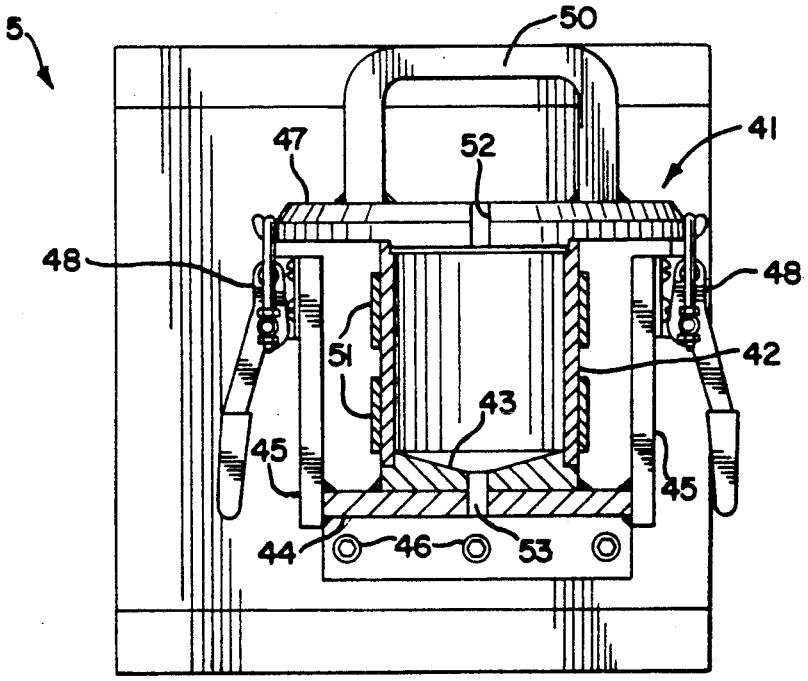
FIG. 4 is a side elevation, partly in section, taken on line 4—4 of FIG. 3.

The desired level of the adhesive 18 in the receptacle 21 is maintained by supplying adhesive upwardly through the bore 36 from a heated supply container indicated generally at 41 (FIGS. 1, 3 and 4). The adhesive supply container 41 comprises a cylindrical receptacle formed by a cylinder 42 (FIG. 4) closed and secured at the bottom by welding to a base 43 which in turn is supported on a bracket 44 from the opposite sides of which upright 45—45 are attached by welding. The bracket 44 is secured to the adjacent frame member 7 (FIGS. 1 and 4) by bolts 46—46.

A cover 47 seals the top of the cylinder 42 and is held tightly in place to form an hermetic seal by a pair of toggle clamps 48—48 of known type. The cover 47 is provided with a handle 50 which can be used to remove the cover when it is time to fill the container 42 with adhesive. The cylinder 42 is provided with electrical resistant heater bands 51—51 of known type which are suitably connected in known manner to a source of electric energization (not shown).

The cover 47 is provided in the center with an opening 52 which may be connected with a source of pressure (not shown) so as to provide and maintain sufficient pressure in the head space in the cylinder or container 42 to force transfer of adhesive into the receptacle 21.

The bottom 43 of the container 42 is provided with an outlet opening 53 to which an adaptor 54 (FIG. 1), which includes a manual valve 55, is connected. The outlet end of the adaptor 54 is connected by a fitting 56 to a jacketed adhesive conduit 57 (FIG. 3). The opposite end of the conduit 57 is provided with a right angle fitting 58 which in turn is connected with a short length of conduit 60 which delivers adhesive to the inlet opening 61 (FIG. 1) at the bottom of the vertical passageway 36.

It will be seen that by opening the valve 55, the pressure in the head space in the container 41 will force adhesive upwardly into the pool of adhesive 18 in the container 21. Thus, by manipulating the valve 55, the body of liquid adhesive in the container 21 can be maintained at an appropriate level.

In order to transfer and apply adhesive from the pool or supply 18 to successive package components 20, means are provided for vertically reciprocating the adhesive and pick-up applicator element 16 between its lowered position shown in FIG. 1 wherein the lip 17 is immersed in the adhesive 18 and its elevated position shown in FIG. 2 wherein the lip 17 engages the seal area of the package component 20. The means of reciprocating element 16 includes a double acting cylinder unit 62 which may be pneumatically operated. The cylinder 62 is mounted on the upper cross piece 8 of the frame and its reciprocating connecting rod 63 is threaded at its upper end and connected to the cross piece 15 by an upper nut 64 and a lower nut 65. As the piston rod 63 reciprocates, it carries with it the cross piece 15 and the vertical guide rods 13. These, in turn, carry with them the bottom cross piece 14 and the adhesive pick-up and applicator element 16.

While the lip 17 on the element 16 is shown with a groove, the lip may have other profiles including being beveled to form a peaked rib. When the lip rises above the surface of the adhesive 18 a predetermined amount of the adhesive will be carried with the lip and applied against the seal area of the package component 20. It will be understood that after adhesive has been applied to the package component 20, the applicator 16 is lowered so that the lip 17 is again immersed in the adhesive 18 and the package component 20 is removed and replaced with another.

Figure 11:
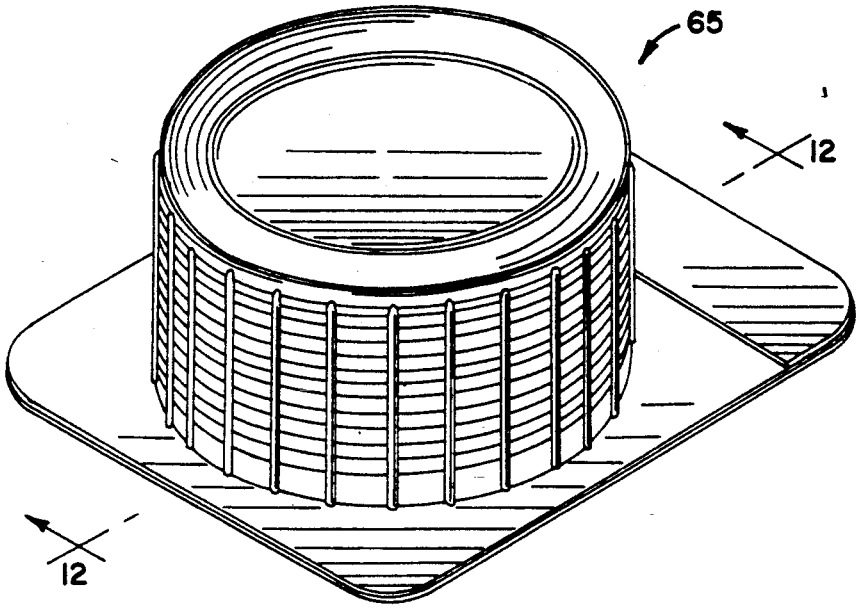
FIG. 11 is a perspective view of a sliced meat package the base component of which has a seal area on which the adhesive was applied and deposited by an apparatus and method in accordance with the present invention.
Figure 12:
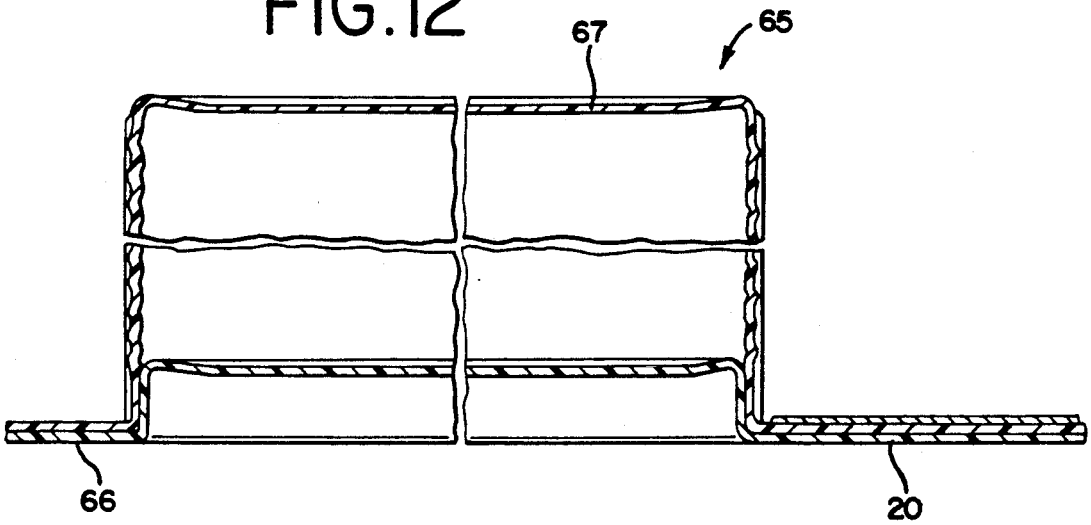
FIG. 12 is a vertical, sectional view taken on line 12—12 of FIG. 11.

The package component 20 to which adhesive has been applied can be utilized as the base in forming the completed sliced meat package indicated generally at 65 in FIGS. 11 and 12. The package 65 corresponds to the package shown in FIGS. 12-14 of the above-mentioned U.S. Pat. No. 3,498,018 the disclosure of which patent is incorporated by reference herein. The package 65 comprises the base 20 and the transparent bubble container 67. The base 20 and bubble 67 have mating flanges which are secured together by the adhesive 66 that has been applied to the seal area of the base 20 in the operation of the unit 5, as above described.

While the adhesive applying unit 5 of FIGS. 1-4 is suitable for small scale production, large scale production can use to advantage a gang of the units operating in unison. The unit indicated generally at 70 in FIGS. 5, 6 and 8-10 provides such a multiple unit. The unit 70 may be internal to a thermoforming mold and includes an enclosure frame comprising a base plate 71, end plates 72 and 73, side plates 74 and 75, an upper plate 76 and a top 77. The top 77 may be a mold part having on the underside twenty embossed areas or daises 78—78 each of which is a die for forming a semi-rigid plastic package component 80 that may correspond to the package component 20 in FIGS. 1, 2, 11 and 12. The details of construction of the mold part or top 77 do not form a part of the present invention. As is well known in the thermoforming art a sheet of plastic covering the underside of the part 77 can be thermoformed by application of heat, suction and/or pressure to form in the sheet twenty individual package components 80.

Within the enclosure frame of the unit 70, there are twenty pedestals 81—81 which correspond generally to the pedestal 24 of the unit 5 in FIGS. 1-4. Each pedestal 81 has a bottom flange or base 82 by which it is mounted on the top of the bottom plate 71. Each pedestal 81 has a vertical center passageway 83 and a pair of heating medium passageways 84 and 85. It will be understood that the center passageways 83 correspond to the central adhesive passageway 36 in the unit 5 while passageways 84 correspond to passageway 37 and passageways 85 correspond to passageway 38, respectively, in the unit 5. Each of the passageways, 83, 84 and 85 extends downwardly into the base plate 71 wherein suitable connections can be made for delivering adhesive to the passageways 83, heating medium to the passageways 84 and withdrawing heating medium from the passageways 85.

Twenty enclosed adhesive bath holders 86—86 are mounted on top of the upper plate 76 and centered directly underneath the formations 78 on the underside of the cover 77. The adhesive baths or pools in the holders 86, are indicated at 87—87. Each of the holders 86 has a annular slot extending vertically therethrough with each slot including an intermediate enlarged annular space 90 (FIG. 5) which communicates with the bath of adhesive 87 through the laterally extending passageways 91—91.

Vertically reciprocable adhesive pick-up and applicator elements 92—92 are mounted on the upper side of a vertically reciprocating plate 93. The sleeve-like elements 92 extend upwardly through the top plate 78 and into the slots 88 through suitable annular seals 94 in each of the holders 86. The elements 92 correspond generally to the adhesive pick-up and applicator element 16 of the unit 5 in FIGS. 1-4 and are similarly provided with grooved lips 95 in which adhesive is picked up and later transferred to the seal areas of the package components 80.

Underneath the vertically reciprocable plate 93 on which the adhesive pick-up and applicator element 92 are mounted two pair of U-shaped brackets 100 are mounted each of which supports between its depending legs a pin 101. Each pin 101 extends through the upper opening in a link 102. A lower pin 103 extends through the lower opening in the link 102. Each pin 103 extends through an opening in the distal end of a support arm 104 which is rotatably mounted at its proximal end on a stationary pin 105 (FIG. 9) carrier by a support 106.

Each pin 103 carries on its end opposite the link 102 a cam follower roller 107. The cam follower rollers 107 are positioned within the cam openings 108—108 in each of the reciprocating cam levers 110—110. Each cam lever 110 is connected at its opposite ends to a support and guide rod 111 and 112. Each guide and support rod 111 reciprocates in a bushing 113 mounted on the outside of frame side plate 72 while each guide and support rod 112 is supported and reciprocates in a bushing 114 mounted on the outside of the opposite side place 73.

Figure 5:
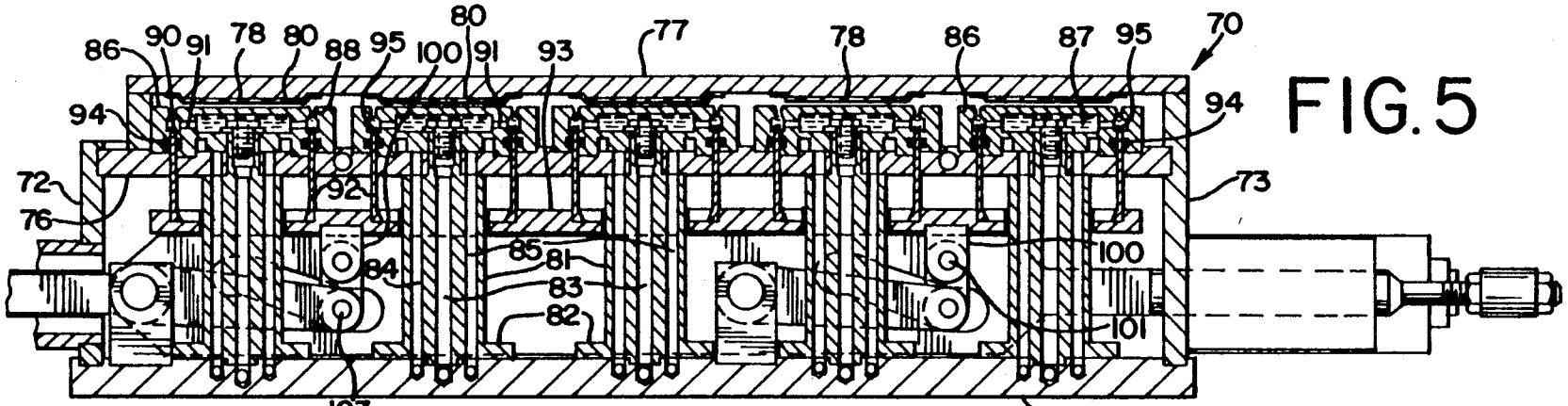
FIG. 5 is a longitudinal vertical sectional view through an adhesive applicator embodying the invention comprising a gang of units and showing the vertically reciprocating adhesive pick-up and applicator elements of the units in their retracted and immersed position.
Figure 6:
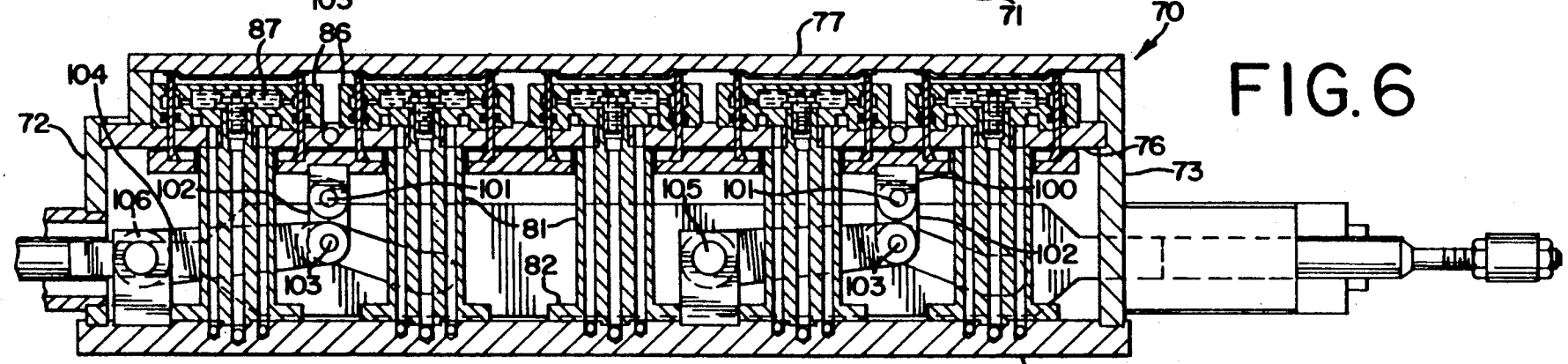
FIG. 6 is a view similar to FIG. 5 but showing the adhesive pick-up and applicator elements in their raised position in engagement with the seal areas of a corresponding number of package components.
Figure 7:
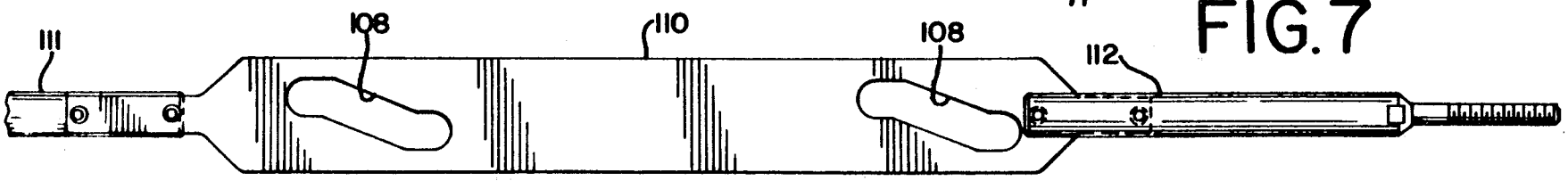
FIG. 7 is a side elevational view of cam-actuating lever forming an element of the apparatus shown in FIGS. 5 and 6.
Figure 8:
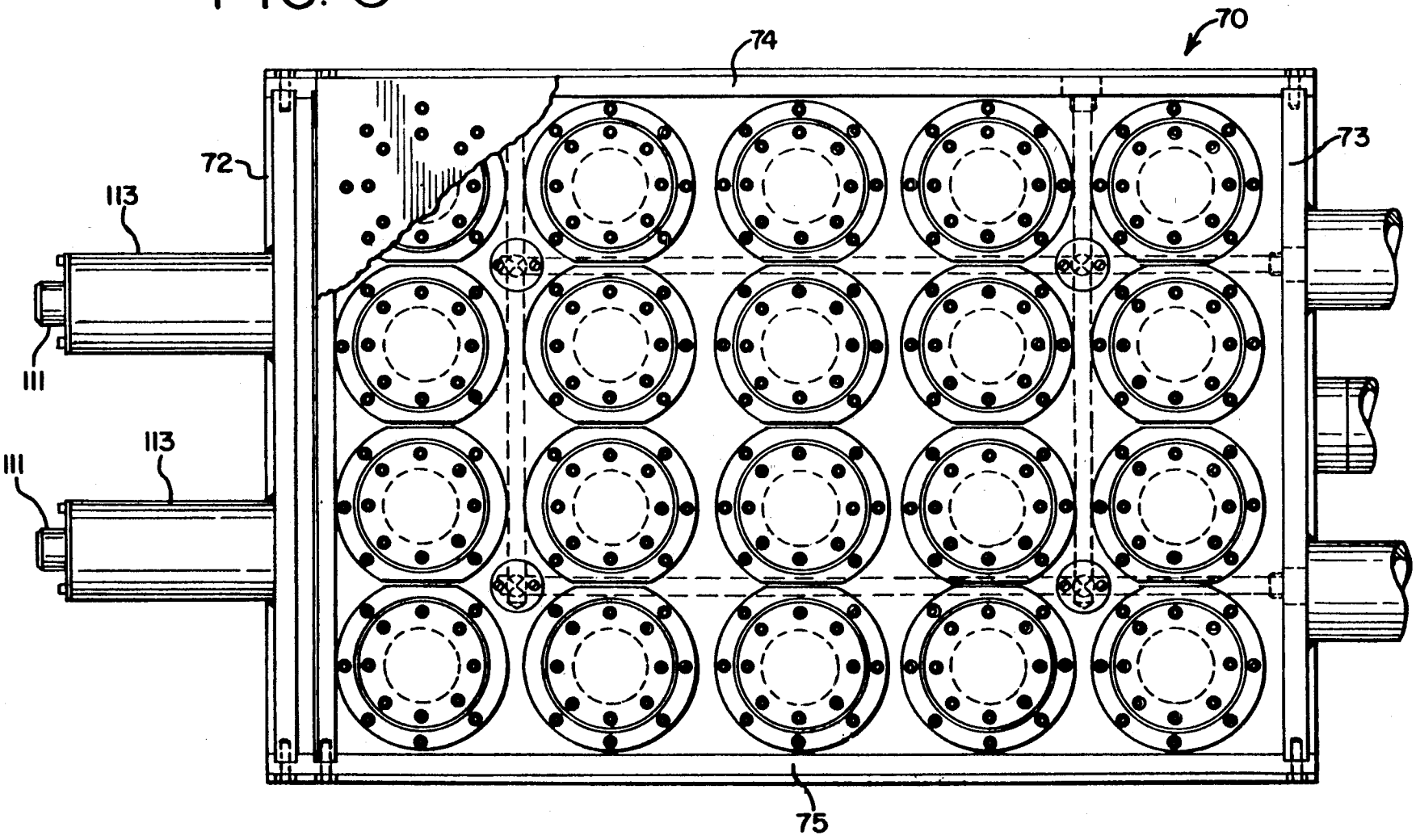
FIG. 8 is a top plan view of the apparatus shown in FIGS. 5 and 6 with most of the package component holding cover removed.
Figure 9:
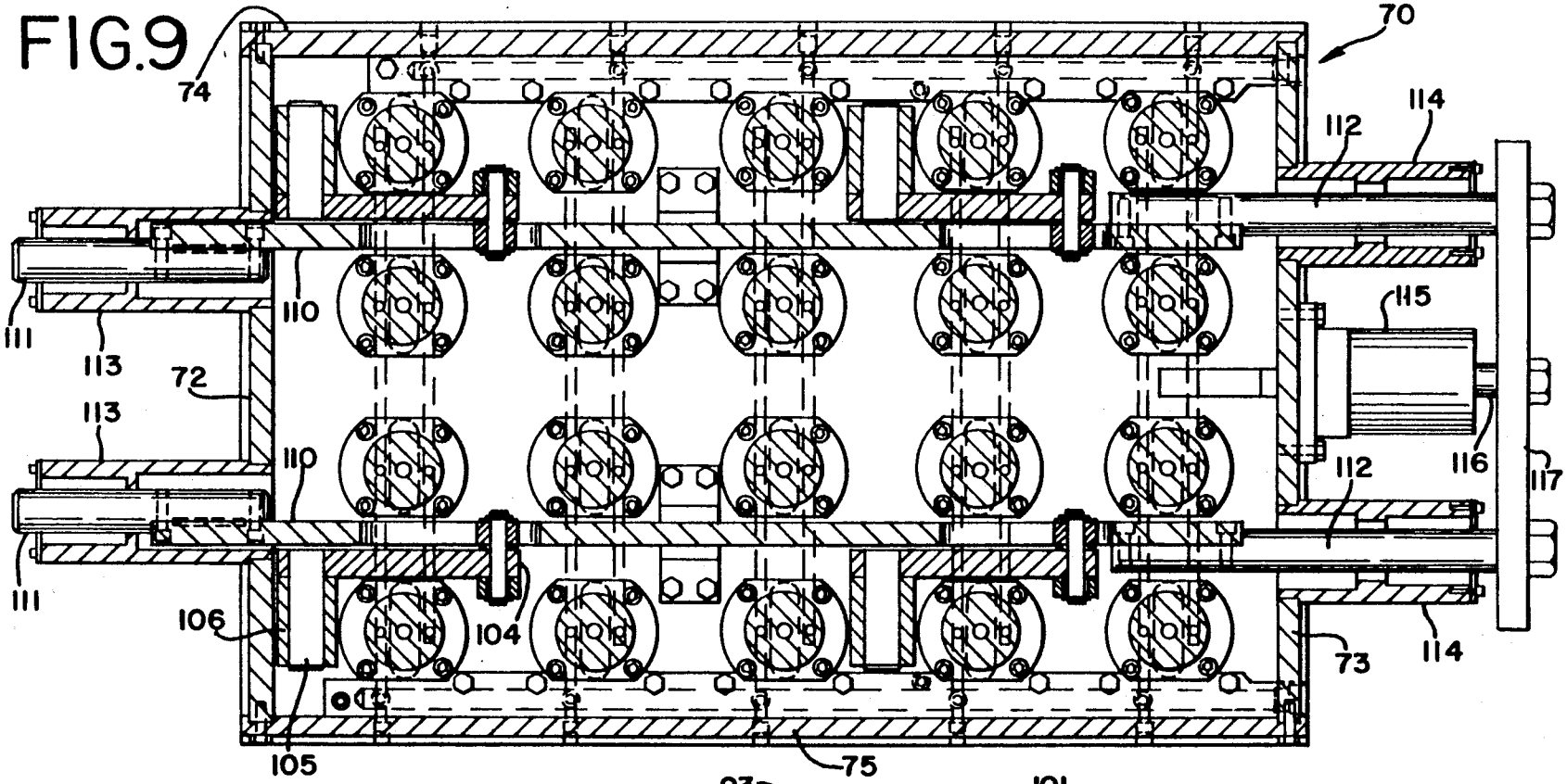
FIG. 9 is a sectional view taken generally on line 9—9 of FIG. 6.
Figure 10:
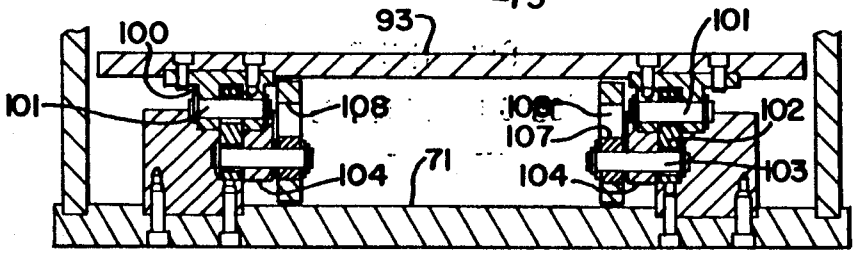
FIG. 10 is a sectional view taken on line 10—10 of FIG. 9.

A double acting pneumatic cylinder 115 is mounted on the side plate 73 between the bushings 114. The connecting rod 116 of the double acting cylinder is rigidly connected to a cross member 117 to opposite ends of which the outer ends of the support and guide rods 112 are connected. It will be seen that by this arrangement that when the connecting rod 116 of the double acting cylinder unit 115 reciprocates it will also cause the cam levers 110 to reciprocate. Such reciprocation causes the cam follower rollers 107 to ride up and down in the cam ways or slots 108 thereby causing the links 102 to reciprocate vertically and in turn cause the pins 101 and the plate 93 to reciprocate vertically. Reciprocation of the plate 93 causes the lips 95 on the adhesive pick-up and applicator elements 92 to rise out of the slots 88 as shown in FIG. 5 to their elevated position as shown in FIG. 6 wherein they engage the seal areas of the package components 80 and apply or deposit adhesive thereon.

What is claimed is:

1. Apparatus for applying adhesive to a predetermined seal area of an article, comprising, a receptacle for containing a body of adhesive, an upright adhesive pick-up and applicator sleeve having an adhesive pick-up and article engaging upper lip with an upper surface corresponding to said predetermined seal area, means operatively connected with said adhesive pick-up and applicator sleeve for reciprocating the same between a lowered position in which said lip is immersed in a body of adhesive in said receptacle and an upper position in which said lip is elevated above said body of adhesive, and an article support for supporting said article in a position wherein said predetermined seal area thereof is engaged for adhesive transfer by said upper surface of said lip in its said upper position and upon such engagement adhesive picked up by and on said upper lip surface is transferred to said predetermined seal area of said article, said receptacle having an annular opening in its bottom through which said sleeve reciprocates.

2. The apparatus of claim 1, wherein said upper surface of said lip is endless and lies in a horizontal plane.

3. The apparatus of claim 1, wherein said upper surface of said lip includes a profile on which adhesive is picked up and retained.

4. The apparatus of claim 1 which includes a second receptacle for containing a second body of said adhesive which second body is of greater volume than said first mentioned body of adhesive, and conduit means interconnecting said first mentioned receptacle and said second receptacle whereby said second body of adhesive provides a supply of adhesive to replenish adhesive removed from said first mentioned body of adhesive.

5. Apparatus for simultaneously applying adhesive to a predetermined seal area of each of a plurality of articles, comprising, a gang of adhesive applying units with each unit comprising: a receptacle for containing a body of adhesive, an upright adhesive pick-up and applicator sleeve having an adhesive pick-up and article engaging upper lip with a surface corresponding to said predetermined seal area, means operatively connected with said adhesive pick-up and applicator sleeve for reciprocating the same between a lowered position in which said lip is immersed in a body of adhesive in said receptacle and an upper position in which said lip is elevated above said body of adhesive, and an article support for supporting said article in a position wherein said predetermined seal area thereof is engaged for adhesive transfer by said upper surface of said lip in its said upper position and upon such engagement adhesive picked up by and on said upper surface is transferred to said predetermined seal area of said article, said receptacle having an annular opening in its bottom through which said sleeve reciprocates.

6. The apparatus of claim 5, wherein said reciprocating means operatively connected with said adhesive pick-up and applicator sleeves of said adhesive applying units are operatively interconnected so as to reciprocate in unison and thereby pick up and apply adhesive in unison.

7. The apparatus of claim 5, wherein said article supports for a plurality of said adhesive applying units are integral.

8. The apparatus of claim 5 which is housed on the interior of thermoforming mold.

* * * * *